United States Patent [19]

Kawahara et al.

[11] Patent Number: 4,975,304

[45] Date of Patent: Dec. 4, 1990

[54] COATING METHOD

[75] Inventors: Sei Kawahara; Toshiyuki Ogura; Shogo Isayama; Matsutaroh Hirose, all of Shizuoka, Japan

[73] Assignee: Fuji Photo Film Co., Ltd., Kanagawa, Japan

[21] Appl. No.: 393,927

[22] Filed: Jun. 30, 1982

[30] Foreign Application Priority Data

Jun. 30, 1981 [JP] Japan ..... 56-101739

[51] Int. Cl.[5] ..... B05D 1/30

[52] U.S. Cl. ..... 427/264; 427/275; 427/299; 427/420; 118/DIG. 4

[58] Field of Search ..... 427/264, 275, 299, 326, 427/411, 420; 118/44, 50, 407, 411, 412, DIG. 4

[56] References Cited

U.S. PATENT DOCUMENTS

| | | | |
|---|---|---|---|
| 1,618,809 | 2/1927 | Byron et al. | 118/44 |
| 3,557,752 | 1/1971 | Hakanson | 118/44 |
| 4,135,477 | 1/1979 | Ridley | 427/420 X |
| 4,233,346 | 11/1980 | Kerkhofs | 427/420 |

*Primary Examiner*—Shrive Beck

*Attorney, Agent, or Firm*—Sughrue, Mion, Zinn, Macpeak & Seas

[57] ABSTRACT

A method of curtain coating that applies a free falling curtain of liquid coating composition onto a running support is disclosed. In the method, the sides of the support parallel to the running direction of the support are bent downwardly before the curtain is applied, and thus are not coated, and are subsequently unbent.

12 Claims, 3 Drawing Sheets

COATING METHOD

BACKGROUND OF THE INVENTION

1. Field of the Invention

The present invention relates to a method of applying a liquid coating composition onto a moving support by curtain coating, and more particularly, to a method of applying a variety of liquid coating compositions onto the support without causing non uniformity in layer thickness adjacent the edges.

2. Description of the Prior Art

While curtain coating has been developed for many years in the painting and packaging fields, coating operations exhibiting greater accuracy and higher productivity are in demand. To meet this end, U.S. Pat. No. 3,508,947, 3,232,743, Japanese Pat. Application (OPI) Nos. 74761/77 and 74762/77 (the term "OPI" as used herein refers to a "published unexamined Japanese Pat. application") have proposed the application of curtain coating in the manufacture of photographic materials, pressure-sensitive copying paper and heat-sensitive recording paper.

Curtain coating fundamentally consists of the rapid horizontal movement of the support (the flat article to be coated) through a free falling curtain supported by two edge guides at both ends in a transverse direction. But if the entire width of the curtain is applied to the support using these edge guides, the coating applied at the edges of the support would be thicker than that applied to the major portion of the support. This presents many problems in the industrial application of the curtain coating process. First, this would complicate the drying problem unless the edges of the support were subsequently trimmed off. Or, if the drying section does not have sufficient capability to dry the thick coat, it remains only partially dry and the wet coating solution fouls the surface of the transport rollers in subsequent steps, or both edges of the support stick to the winding rolls so strongly that the support often breaks when it is unwound in the slitting step. It is therefore necessary to prevent this phenomenon by giving the drying apparatus the additional capacility to dry the thick coat.

Secondly, the thick coat is only about a few milimeters wide and is not included in the final product but is simply discarded. It is certainly uneconomical to spend extra money in drying such undesired portions.

Thirdly, even if the thick coat is appropriately dried, the web when wound about the winding roll many times forms a ridge on both ends due to the accumulation of the thick coat, and if the formation of such ridge is excessive, a support of thin plastic sheet deforms when it is wound up, and a paper support breaks apart on that ridge to make the winding of a sufficiently long web difficult. In either case, the production efficiency is greatly reduced.

It is known that a curtain is generally made wider than the support to be coated to ensure that the coating applied to the support is of uniform thickness right to its edges. When a single component layer is formed on the support by this technique, the liquid coating composition in that part of the curtain which extends beyond the side edges of the support and which simply falls down without being applied to the support is recovered and recycled for further use.

Methods of coating superposed layers on the support are described in U.S. Pat No. 4,019,906, U.S. Pat. No. 4,135,477, and U.S. Pat. No. 4,233,346,wherein only some of the plurality of layers are, and in the extreme case only one layer is, in contact with the curtain guides. The width of the remaining layers is smaller than the width determined by the curtain guides, and preferably smaller than the width of the web. All of the free falling curtain composed of a plurality of layers is coated onto the support wherein the portion of said one, broader layer that overflows the edges of the web is collected and recirculated. These methods are known to be capable of overcoming the problems related with the edge regions of the curtain.

The above described methods depend on the formation of a curtain wider than the support. But even if a uniform thickness is maintained right to its edges, those portions of the support often have inherently poor properties and are not usually included in the final product, so the liquid coating composition applied to those portions is simply wasted. In addition, the coating machine is designed so that the liquid coating composition is applied to the entire surface of the support, so it sometimes occurs that the liquid coating composition is undersirably applied to the side edges and fouls the rolls or belts that transport the support. If a paper substrate is used as in the manufacture of pressure-sensitive copying paper or heat sensitive recording paper, the sides of the paper coated with the liquid coating composition curl downward to a great extent, and as a result, the curled side bands contact the transport rolls and foul them with the liquid coating composition before the web enters the drying zone.

Even in the drying step, the curled side bands contact and foul the canvas belt or rolls before the web becomes completely dry. In a "floater dryer" as described in Japanese Patent Application (OPI) No. 25066/79 which achieves both web transport and drying without contacting any transport means, the curled side bands "shudder" and frequently foul the nozzles of the floater dryer.

If the fouling of the equipment is continued, the undesired buildup of the liquid coating composition may cause the paper substrate to break or to be dislodged from the equipment and undesirably deposited on a freshly coated surface to damage it.

SUMMARY OF THE INVENTION

Therefore, the primary object of the present invention is to provide a method of curtain coating which is free from the above described defects of the conventional technique due either to the formation of a thick coat adjacent the edges of the support or to the application of a curtain wider than the support.

This object of the present invention can be achieved by applying a free-falling curtain of liquid coating composition onto a moving support after folding the sides of the substrate. The advantages of the present invention will be apparent from the following description in conjunction with the accompanying drawings.

BRIEF DESCRIPTION OF THE DRAWINGS

FIG. 5(*b*) is a sectional view of the hopper used as a feed head taken on the line A—A′ in FIG. 5(*a*);

FIG. 6(*b*) is a sectional view of the hopper used as a feed head taken on the line B—B′ in FIG. 6(*a*).

DETAILED DESCRIPTION OF THE PREFERRED EMBODIMENTS

Figure 1:
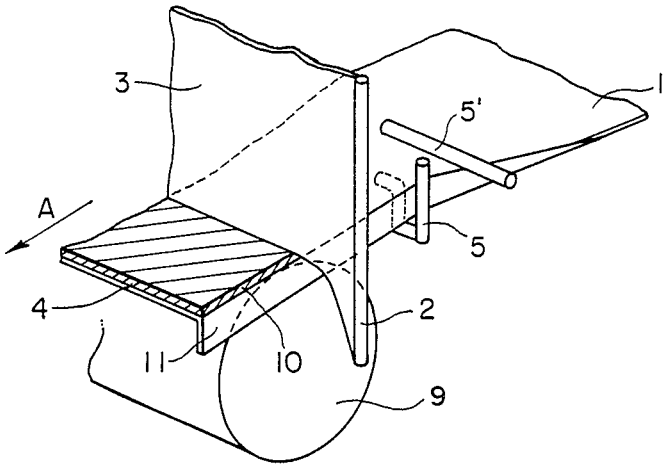
FIG. 1 is a perspective view showing the essential parts of one embodiment of the invention.

FIG. 1 is a perspective view showing the essential parts of one embodiment of the invention. Each side of a support 1 running in the direction indicated by arrow A is bent downwardly by a folder 5 or an optional auxiliary bar 5′ that presses the surface of the support. Thereafter, a free falling curtain 3 of liquid coating composition that is defined by an edge guide 2 on both edges and which is wider than the support is formed and applied to the partially bent support to form a coated layer 4. The liquid coating composition forming that part of the curtain which extends beyond the bent corner 10 of the substrate forms a vena contracta (contracted vein) as it falls down, so no liquid coating composition is applied to the downwardly bent portion 11 of the substrate. Therefore, the coating solution is not applied in the "uneven areas" near the edge guides and a uniform coat is formed on the entire surface of the flat portion of the substrate. In particular, a paper support will not curl downwardly after it is coated with the liquid coating composition.

Figure 2:
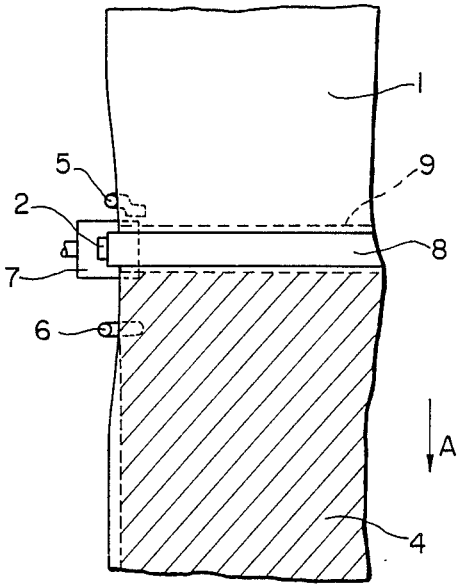
FIG. 2 is a plan view of FIG. 1.

FIG. 2 is a plan view of FIG. 1 and shows the features of the present invention more specifically. Each edge of the support 1 running in the direction indicated by arrow A is bent downwardly by the folder 5, and a feed head 8 supplies a freefalling curtain wider than the bent substrate and deposits a coated layer 4 (shown by the hatched area) on the support. The liquid coating composition forming that part of the curtain extending beyond the bend edge of the support falls and forms a vena contracta, and is recycled to a recovery container 7 for further use.

The downwardly bent side bands of the support that remain uncoated pass through the coating zone and return to their original state by themselves. If a too rapid restoration to the original state is expected, a fold retainer 6 may be used to provide the desired downward bend until the support has passed through the coating zone. Therefore, no liquid coating composition is applied to the "uneven areas" near the edge guides and a uniform coated layer 4 is formed on the entire surface of the flat portion of the support. As a further advantage, the uncoated downwardly bent side bands of the support will return to their original state by themselves after passing through the coating zone and form no downward curl.

Figure 3:
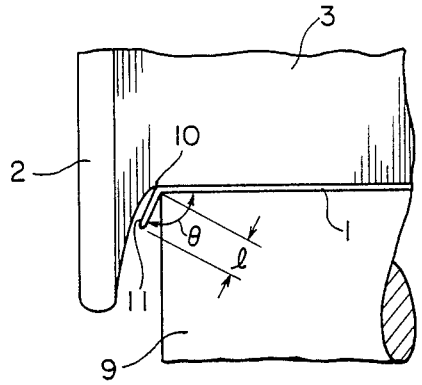
FIG. 3 is a partial enlarged sectional view of FIG. 1.

FIG. 3 is an enlarged view of the bent edge of the support as it passes through the coating zone. The support 1 is bent downwardly on one lateral side at an angle of $\theta$ to form a lip having a length l, and a free-falling curtain defined by the edge guide 2, which is wider than the unbent flat portion of the substrate, is applied onto the support as it is supported by backing roll 9. The bending angle $\theta$ is generally not more than 120 degrees, preferably not more than 100 degrees. The only requirement for this angle is that the liquid coating composition forming the curtain on the bent corner 10 of the support be sufficiently separate from the lip so as not to coat it and flow along the edge guide while forming a vena contracta. On the other hand, the bent portion of the support must be restorable to its original state so that it does not adversely affect the subsequent steps and produce a defective product. Therefore, the exact bending angle is determined empirically in consideration of the viscosity of the liquid coating composition, its surface tension, the flow rate per unit width, the radius of curvature of the corner 10 (which depends on the flexural rigidity of the support, which in turn depends on the thickness and type of the support), as well as the wettability of the support.

The length l of the lip naturally depends on the desired dimensions on the final product, and the minimum requirement is that a uniform thickness of coated layer be formed in that transverse area of the support which must provide a uniform final product. Generally, a length of not more than about 10 mm is selected in view of economy and from practical considerations (i.e., the side areas of the support often have poor properties and a uniform lip must be formed easily).

Figure 4:
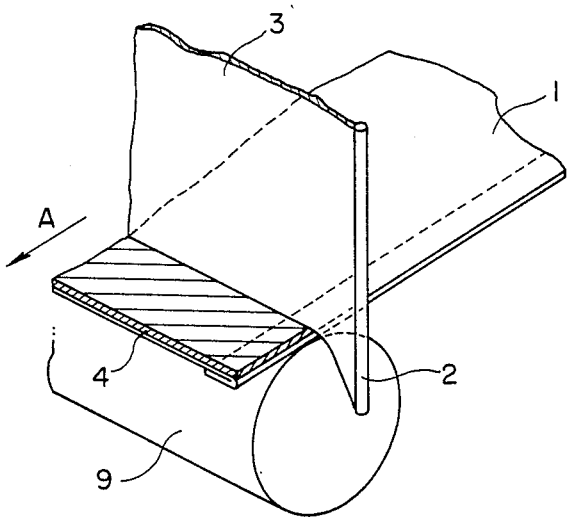
FIG. 4 is a perspective view showing another embodiment of the present invention.

FIG. 4 is a perspective view showing another embodiment of the present invention, wherein the bending angle $\theta$ is zero and the lip is folded back to the underside of the support on the backing roll 9 as a free-falling curtain 3 is applied to the flat portion of the substrate. Neither the device for folding back the lip nor a tool for restoring the support to an unfolded state is shown in FIG. 4.

The advantages of the present invention are now described in a more specific manner by the following examples to which the invention is by no means limited.

EXAMPLE 1

Figure 5A:
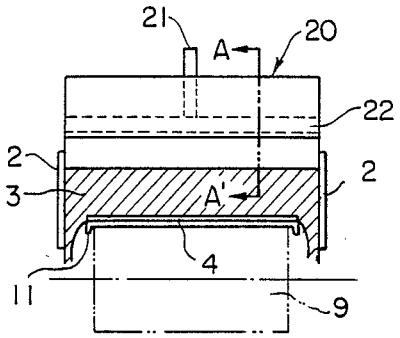
FIG. 5(*a*) is a front view of the applicator used in Example 1.
Figure 5B:
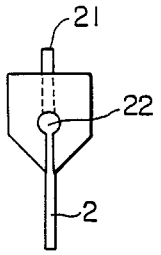

FIG. 5 is a schematic diagram showing the curtain coater used in this example. In the figure, the numeral 20 indicates a conventional extrusion hopper, 21 is a nozzle through which the liquid coating composition is supplied, and 22 is a liquid retainer.

A web of paper (800 mm wide, basis wt: 40 g/m$^2$) running at 600 m/min was set in the curtain coater of FIG. 5 and both sides to a width of 5 mm were bent downwardly at a right angle to leave a flat surface 790 mm wide. Then, a free falling curtain 800 mm wide made of a coating solution for pressure-sensitive copying paper having the composition indicated in Table 1, as well as a solids content of 23 wt%, a viscosity of 40 cps, and a surface tension of 34 dyne/cm (25° C.) was applied to the web at a rate of 15 cc/m$^2$(wet).

TABLE 1

| | |
|---|---|
| Gelatin microcapsules | 18 wt % |
| Surfactant (sodium dodecylbenzenesulfonate amine salt) 3 cc/100 cc<br>Binder (PVA) and protective agent (CMC) 50 g/1,000 cc | 5 wt % |

The liquid coating composition forming that part of the free falling curtain which extended beyond each bent corner of the support fell down as it formed a vena contracta without coating the downwardly bent side bands of the substrate. When the web had passed the coating zone by a distance of about 15 to 20 cm, the bent side bands returned by themselves to a level substantially flush with the coated surface, and no curl developed on either side band of the coated paper.

The web was then dried by a conventional method. No trace of bending was observed, the coating layer was uniform, and an undesired thick coat was substantially absent from the side bands of the coated surface The dried web could be wound up by a roll without forming an undesired ridge on either side of the roll, and an adequately long web roll could be obtained.

EXAMPLE 2

A paper support (200 mm wide, basis wt: 50 g/m$^2$) running at 300 m/min was set in the curtain coater of Example 1 and side bands 3 mm wide were folded back on either side to give a bending angle of zero as shown in FIG. 4. Then, a free falling curtain 204 mm wide made of a coating solution for heat-sensitive recording paper having the composition indicated in Table 2, as well as a solids content of 41 wt%, a viscosity of 96 cps, and a surface tension of 36 dyne/cm (25° C.) was applied to the substrate at a rate of 30 cc/m$^2$ (wet).

TABLE 2

| | |
|---|---|
| Color former (3,3-bis) (p-dimenthyl-aminophenyl)-6-dimethylamino-phthalide | 100 g/1,000 cc |
| Color developer (2,2-bis)(4-hydroxyphenyl)propane | 110 g/1,000 cc |
| Binder (starch) and filler (kaolin) | 200 g/1,000 cc |
| Sulfosuccinate ester | 3 g/1,000 cc |

After completion of the coating, the folded side bands of the support were restored to a level flush with the coated surface by a special tool. The coated web was fed on a canvas belt into a drying zone. The web had a trace of bending and curled downwardly so that the sides of the support contacted the canvas belt. But since those side bands were not coated, no fouling of the canvas belt was observed. The dried web had a satisfactorily uniform coat and an undesired thick coat was substantially absent from the side bands of the coated surface. The web could be wound up by a roll without forming an undersired ridge on either side band of the roll, and a web as long as 25,000 m could be wound without breaking the paper support.

EXAMPLE 3

Figure 6A:
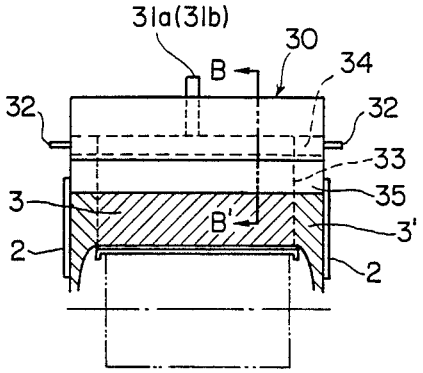
FIG. 6(*a*) is a front view of the applicator used in Example 3.
Figure 6B:
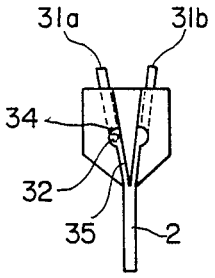

FIG. 6 is a schematic diagram showing the curtain coater used in this example. In the figure, the number 30 indicates a conventional hopper capable of the simultaneous extrusion of two layers, and has a separator 33 that divides the liquid retainer and slot for one of the two layers into a central portion and a side portion. The numeral 34 is a retainer for side curtain coating composition, and 35 is a slot for side curtain coating composition.

A polyethylene terephthalate support (200 mm wide, 80 μthick) running at 100 m/min was wet in the curtain coater of FIG. 6 and side bands 6 mm wide were bent downwardly on either side at an angle of 70 degrees. Then, an integral curtain 200 mm wide made of two superimposed layers 184 mm wide (the compositions and properties of the respective layers are listed in Table 3) and a single layer (whose composition and properties are also listed in Table 3) was applied to the substrate at a rate of 60 cc/m$^2$ (wet)

TABLE 3

| | | |
|---|---|---|
| First sol. | Composition | Gelatin: 8 parts by weight<br>Potassium polystyrenesulfonate (thickner): 0.08 parts by weight<br>Sodium dodecylbenzenesulfonate (surfactant): 0.002 parts by weight<br>$H_2O$: 92 parts by weight<br>Blue Dye: 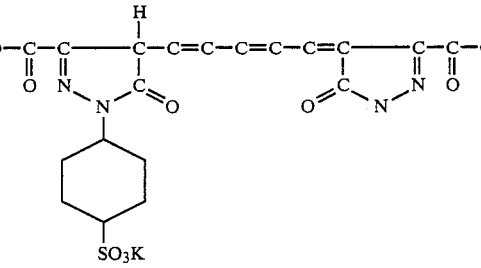 0.002 parts by weight |
| | Properties | Viscosity: 40 cp<br>Surface tension: 35 dyne/cm |
| Second sol. | Composition and properties | Red dye: 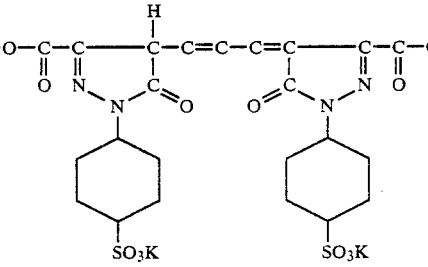 0.003 parts by weight<br>Other components and properties are the same as those of first solution. |
| Third sol. | Composition and Properties | The same as first solution except that no blue dye was used. |

The gelatin solution making that part of the free falling curtain which extended beyond each bent corner of the support fell down as it formed a vena contracta without coating the downwardly bent side bands of the support. After passing through the coating zone, the bent side bands of the polyethylene terephthalate support returned by themselves to a level substantially flush with the coated surface. The web was then dried. The coating layer was uniform and an undesired thick coat was substantially absent from the side bands of the coated surface.

The method of the present invention provides the following advantages.

(1) It provides a coat lacking a thick area in the edge regions. Thus, it eliminates the additional step that has been required in the conventional technique of drying the undesired thick coating. Accordingly, the efficiency of the current dryer can be improved by using the method of the present invention.

(2) The absence of an undesired thick coat eliminates the possibility of a partially dry thick coat fouling the equipment. Therefore, the production line need not be interrupted to clean the equipment, and hence, a significant improvement in productivity is achieved.

(3) In addition to the elimination of the undesired thick coat from the side areas of the substrate, the method leaves both lateral sides of the substrate uncoated and eliminates the possibility of the side bands curling downward and fouling the equipment. Therefore, again, the production line need not be interrupted for cleaning the equipment, leading to an improvement in productivity.

What is claimed is:

1. A method of curtain coating a running support, comprising:

downwardly bending at least one side of the support which extends parallel to a running direction of the support, and subsequently applying a free falling curtain of a liquid coating composition onto the unbent portion of the running support while supporting said curtain at lateral sides thereof with side guides, said at least one side of said support being bent downwardly by an amount sufficient so that no part of said curtain contacts said at least one downwardly bent side.

2. A method as claimed in claim 1, wherein said at least one side is bent at angle of not more than 120° with respect to a plane of a main body of the support.

3. A method as claimed in claim 1, further comprising the step of forming said curtain so as to have a width which is wider than said support in an unbent state, portions of the curtain extending outwardly of a main body of said support forming vena contractae.

4. A method as claimed in claim 3, the bent sides of said support remaining uncoated due to said vena contractae.

5. A method as claimed in claim 1, wherein said at least one side is bent at an angle of not more than 100° with respect to the plane of a main body of the support.

6. A method as claimed in claim 1, further comprising unbending said at least one side of said support following coating of said unbent portion of said support.

7. A method as claimed in claim 6, said unbending being effected by the natural elasticity of said support.

8. A method as claimed in claim 6, said unbending being effected by unfolding tool means.

9. A method as claimed in claim 1, further comprising the step of downwardly bending both sides of said support which extend parallel to said running direction, both of said sides being downwardly bent by an amount sufficient so that no part of said curtain contacts said downwardly bent sides.

10. A method as claimed in claim 9, further comprising the step of forming said curtain so as to have a width greater than a width of an unbent portion of said support.

11. A method of curtain coating a running support, comprising:

bending a first side of the support which extends parallel to a running direction of the support downwardly, bending an opposite second side of said support which extends parallel to said running direction of said support downwardly, and subsequently applying a free falling curtain of a liquid coating composition comprising a plurality of constituent layers onto an unbent portion of the running support, said first and second sides being bent by an amount sufficient so that no part of said curtain contacts said first and second sides of said support.

12. A method of curtain coating a running support, comprising:

bending the sides of the support parallel to the running direction of the support downwardly at an angle of not more than 100° with respect to a plane of a main body of said support, supporting said curtain at lateral sides with side supports, and applying a free falling curtain of a liquid coating composition onto the running support, said curtain being formed wider than said support in an unbent state, the portions of the current extending outwardly of the main body of said support forming vena contractae, the bent sides of said support remaining uncoated due to said vena contractae.

* * * * *